US009360835B2

(12) United States Patent
Fujii

(10) Patent No.: US 9,360,835 B2
(45) Date of Patent: Jun. 7, 2016

(54) SUBSTRATE MOUNTING STRUCTURE, DEVELOPER CONTAINER, IMAGE FORMING UNIT, IMAGE FORMING APPARATUS, AND SUBSTRATE MOUNTING METHOD

(71) Applicant: Oki Data Corporation, Tokyo (JP)

(72) Inventor: Masashi Fujii, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/281,068

(22) Filed: May 19, 2014

(65) Prior Publication Data

US 2014/0341606 A1 Nov. 20, 2014

(30) Foreign Application Priority Data

May 20, 2013 (JP) ..... 2013-106436

(51) Int. Cl.

| | |
|---|---|
| ***G03G 15/00*** | (2006.01) |
| ***G03G 21/18*** | (2006.01) |
| ***G03G 15/08*** | (2006.01) |
| *G03G 21/16* | (2006.01) |

(52) U.S. Cl.

CPC ..... *G03G 21/1885* (2013.01); *G03G 15/0863* (2013.01); *G03G 21/1652* (2013.01); *G03G 21/1657* (2013.01); *G03G 2215/0697* (2013.01); *G03G 2221/1823* (2013.01); *Y10T 29/49826* (2015.01)

(58) Field of Classification Search

CPC ..... G03G 15/0863; G03G 21/1657; G03G 21/1875; G03G 21/1878; G03G 21/1885; G03G 2215/0695; G03G 2215/0697; G03G 2221/1823

USPC ..... 399/90, 110, 111, 119, 262, 12, 25, 399/107, 258; 249/346.04

See application file for complete search history.

(56) References Cited

U.S. PATENT DOCUMENTS

| | | | | |
|---|---|---|---|---|
| 6,184,514 | B1 | 2/2001 | Rezende et al. | |
| 2005/0135838 | A1 | 6/2005 | Miller | |
| 2007/0177200 | A1* | 8/2007 | Ohta | 358/1.15 |
| 2007/0230999 | A1* | 10/2007 | Shimomura | 399/113 |
| 2010/0008693 | A1* | 1/2010 | Hayashi et al. | 399/90 |
| 2011/0123216 | A1* | 5/2011 | Mitsuishi et al. | 399/106 |
| 2012/0200871 | A1* | 8/2012 | Takahashi et al. | 358/1.9 |

FOREIGN PATENT DOCUMENTS

| | | | |
|---|---|---|---|
| EP | 1338931 | A1 | 8/2003 |
| JP | 2012-247567 | A | 12/2012 |

* cited by examiner

*Primary Examiner* — Benjamin Schmitt
(74) *Attorney, Agent, or Firm* — Rabin & Berdo, P.C.

(57) ABSTRACT

A substrate mounting structure includes: a substrate member including a substrate portion, the substrate portion having first and second surfaces opposite to each other in a thickness direction of the substrate portion, first to fourth edges, and a predetermined thickness in the thickness direction; a first mounting member on which the substrate member is placed; and a second mounting member attached to the first mounting member to hold the substrate member on the first mounting member. The first mounting member includes first, second, and third restricting portions abutting on the first edge, the second edge, and the second surface to restrict movement of the substrate member, respectively. The second mounting member includes fourth, fifth, and sixth restricting portions abutting on the third edge, the fourth edge, and the first surface to restrict movement of the substrate member.

18 Claims, 11 Drawing Sheets

SUBSTRATE MOUNTING STRUCTURE, DEVELOPER CONTAINER, IMAGE FORMING UNIT, IMAGE FORMING APPARATUS, AND SUBSTRATE MOUNTING METHOD

BACKGROUND OF THE INVENTION

1. Field of the Invention

The present invention relates to a substrate mounting structure, a developer container, an image forming unit, an image forming apparatus, and a substrate mounting method.

2. Description of the Related Art

In Japanese Patent Application Publication No. 2012-247567, Ishiguro et al. describe an image forming apparatus including an image forming unit. The image forming unit has a main body and a toner cartridge detachably attached to the main body. When the toner contained in the toner cartridge is used up, the toner cartridge is replaced with another one.

SUMMARY OF THE INVENTION

An aspect of the present invention is intended to facilitate mounting of a substrate member.

According to an aspect of the present invention, there is provided a substrate mounting structure including: a substrate member including a substrate portion, the substrate portion having a first surface and a second surface opposite to each other in a thickness direction of the substrate portion, first to fourth edges, and a predetermined thickness in the thickness direction; a first mounting member on which the substrate member is placed; and a second mounting member attached to the first mounting member to hold the substrate member on the first mounting member. The first mounting member includes a first restricting portion abutting on the first edge to restrict movement of the substrate member, a second restricting portion abutting on the second edge to restrict movement of the substrate member, and a third restricting portion abutting on the second surface to restrict movement of the substrate member in the thickness direction. The second mounting member includes a fourth restricting portion abutting on the third edge to restrict movement of the substrate member, a fifth restricting portion abutting on the fourth edge to restrict movement of the substrate member, and a sixth restricting portion abutting on the first surface to restrict movement of the substrate member.

According to an another aspect of the present invention, there is provided a developer container including the above described substrate mounting structure.

According to an another aspect of the present invention, there is provided an image forming unit including the above described substrate mounting structure.

According to an another aspect of the present invention, there is provided an image forming apparatus including the above described substrate mounting structure.

According to an another aspect of the present invention, there is provided a substrate mounting method including: placing a substrate member on a first mounting member, the substrate member including a substrate portion, the substrate portion having a first surface and a second surface opposite to each other in a thickness direction of the substrate portion, first to fourth edges, and a predetermined thickness in the thickness direction; and attaching a second mounting member to the first mounting member to hold the substrate member on the first mounting member. The first mounting member includes a first restricting portion abutting on the first edge to restrict movement of the substrate member, a second restricting portion abutting on the second edge to restrict movement of the substrate member, and a third restricting portion abutting on the second surface to restrict movement of the substrate member in the thickness direction. The second mounting member includes a fourth restricting portion abutting on the third edge to restrict movement of the substrate member, a fifth restricting portion abutting on the fourth edge to restrict movement of the substrate member, and a sixth restricting portion abutting on the first surface to restrict movement of the substrate member.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Embodiments of the invention will now be described with reference to the attached drawings. In each of the embodiments, a printer will be described as an example, of an image forming apparatus.

First Embodiment

Figure 2:
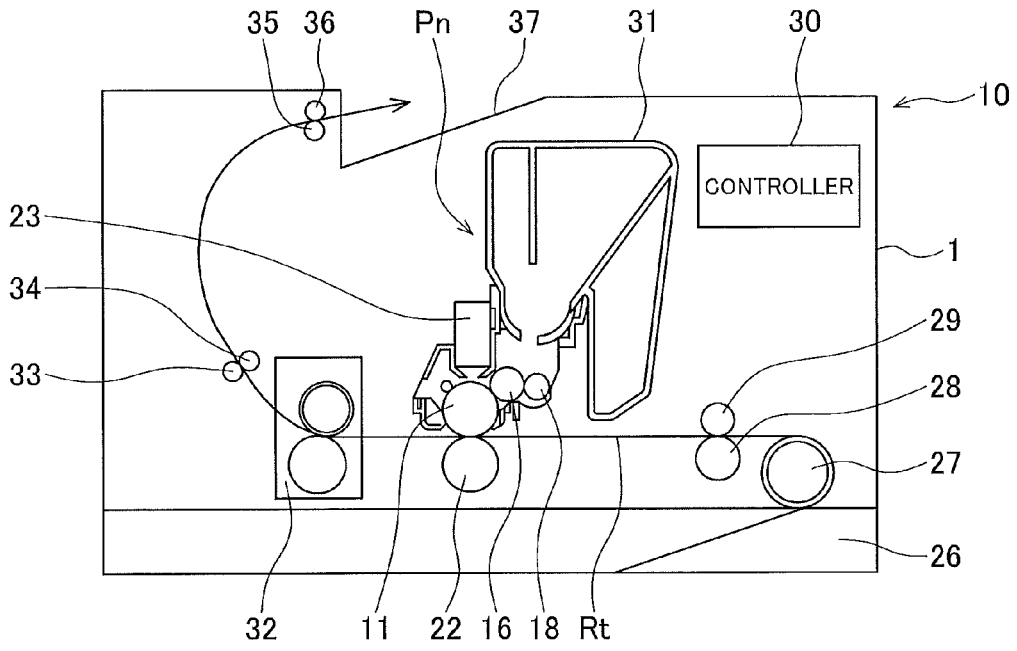
FIG. 2 is a schematic view of a printer in the first embodiment.

FIG. 2 is a schematic view of a printer 10 in the first embodiment.

In FIG. 2, the printer 10 includes a paper feeding cassette 26 serving as a medium storage unit that stores a paper P (see FIG. 3) as a recording medium, a hopping roller 27 that feeds the paper P from the paper feeding cassette 26 into a paper conveying path Rt as a medium conveying path, conveying rollers 28, 29, 33, and 34 that convey the fed paper P, discharge rollers 35 and 36 that discharge the conveyed paper P outside an apparatus main body 1 that is a main body of the printer 10, and a stacker 37 on which the discharged paper P is stacked.

An image forming section Pn is provided on the downstream side of the conveying rollers 28 and 29, and a fixing device 32 is provided on the downstream side of the image forming section Pn, in the paper conveying path Rt. The image forming section Pn includes an image forming unit 31 as a first replacement unit; a light-emitting diode (LED) head 23 as an exposure device, and a transfer roller 22 as a transfer member. The image forming unit 31 is detachably and replaceably disposed in the apparatus main body 1, and replaced with a new one when the life of a component of the image forming unit 31 expires. The apparatus main body 1 includes a controller 30 that controls the operation of the printer 10.

Figure 3:
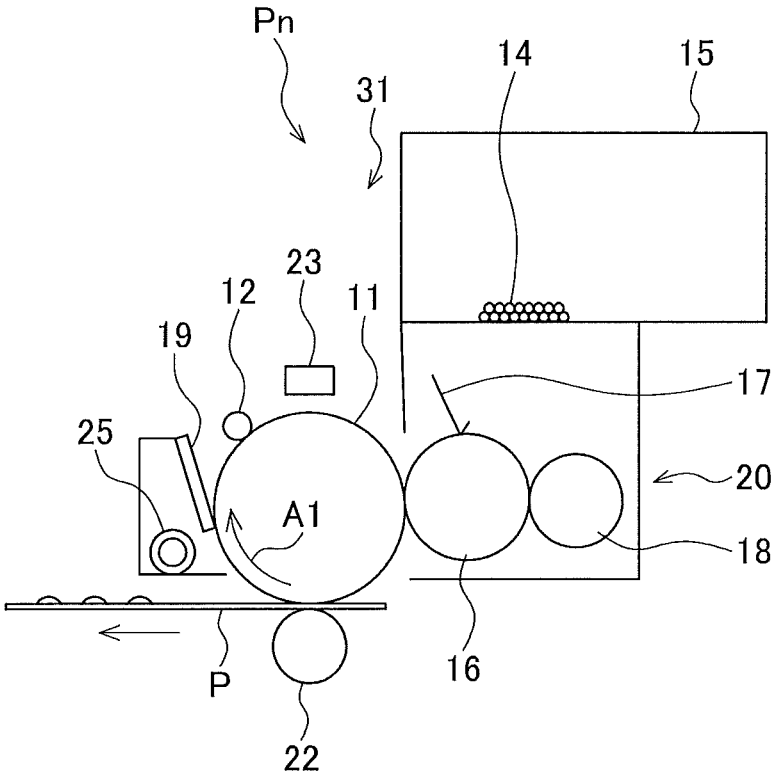
FIG. 3 is a schematic view of an image forming section in the first embodiment.

FIG. 3 is a schematic view of the image forming section Pn. The image forming section Pn will be described with reference to FIG. 3.

The image forming unit 31 includes an image forming unit main body 20 that is a main body of the image forming unit 31, and a toner cartridge (or a developer container) 15 as a second replacement unit. The toner cartridge 15 stores toner 14 as developer, and is detachably and replaceably attached to the image forming unit main body 20. The toner cartridge 15 is replaced with a new one when the toner 14 therein is used up.

The image forming unit main body 20 includes a photosensitive drum 11 as an image carrier, a charging roller 12 as a charging device, a developing roller 16 as a developer carrier, a developing blade 17 as a developer layer regulating member, a toner supplying roller 18 as a developer supplying member, a cleaning blade 19 as a cleaning member, and the like. The photosensitive drum 11 is driven by a motor (not shown) as a driving unit to rotate in a direction indicated by arrow A1 in FIG. 3. The charging roller 12 is rotatably disposed in contact with the photosensitive drum 11 at a predetermined pressure. The charging roller 12 rotates in a direction opposite to the rotational direction of the photosensitive drum 11, and uniformly charges a surface of the photosensitive drum 11. The LED head 23 is disposed above and opposite to the photosensitive drum 11, and illuminates the charged surface of the photosensitive drum 11 to remove charges on the photosensitive drum 11, thereby forming an electrostatic latent image as a latent image. The developing roller 16 rotates in a direction opposite to the rotational direction of the photosensitive drum 11, and supplies the toner 14 to the photosensitive drum 11 to develop the electrostatic latent image, thereby forming a toner image as a developer image. The developing blade 17 is disposed with its tip in contact with the developing roller 16 at a predetermined pressure, and regulates a thickness of a layer of the toner 14 on the developing roller 16 to form a toner layer as a developer layer with a predetermined thickness. The toner supplying roller 18 rotates in the same direction as the rotational direction of the developing roller 16 to supply the toner 14 supplied from the toner cartridge 15 to the developing roller 16 while charging the toner 14.

The transfer roller 22 is disposed below and opposite to the photosensitive drum 11, and transfers the toner image from the photosensitive drum 11 onto the paper P conveyed on the paper conveying path Rt.

The cleaning blade 19 is disposed with its tip in contact with the photosensitive drum 11 at a predetermined pressure, and scrapes off any toner 14 which may remain on the photosensitive drum 11 after the transfer of the toner image. The scraped-off toner 14 is conveyed to a waste toner container 43 (see FIG. 4), described later, as waste toner by a conveying spiral 25 as a developer conveying member disposed below the cleaning blade 19.

Next, the operation of the printer 10 will be described.

The paper P stored in the paper feeding cassette 26 is fed to the paper conveying path Rt with the rotation of the hopping roller 27, conveyed by the conveying rollers 28 and 29 to the image forming section Pn, and passes between the photosensitive drum 11 and the transfer roller 22.

In the image forming section Pn, a predetermined voltage is applied to the charging roller 12, and the surface of the photosensitive drum 11 is uniformly charged by the charging roller 12. The charged surface of the photosensitive drum 11 is irradiated with a light from the LED head 23. Thereby, charges in an image area to be developed with the toner 14 on the photosensitive drum 11 are removed, so that an electrostatic latent image is formed.

The toner 14 in the toner cartridge 15 is supplied to the developing roller 16 by the toner supplying roller 18, and is regulated by the developing blade 17, so that a toner layer with a predetermined thickness is formed on the developing roller 16. The toner layer is brought into contact with the photosensitive drum 11 to develop the electrostatic latent image, forming a toner image.

While the paper P passes between the photosensitive drum 11 and the transfer roller 22, the toner image formed on the photosensitive drum 11 is transferred onto the paper P by the transfer roller 22.

After the transfer, toner 14 remaining on the photosensitive drum 11 is scraped off by the cleaning blade 19. The scraped-off toner 14 is conveyed by the conveying spiral 25 to a side frame (not shown) of the printer 10, passed through a conveying route formed in the side frame, and stored in the waste toner container 43.

The paper P with the toner image transferred thereon is conveyed to the fixing device 32, in which the toner image is fixed to the paper P.

The paper P with the toner image fixed thereto is conveyed by the conveying rollers 33 and 34, and discharged by the discharge rollers 35 and 36 out of the apparatus main body 1 onto the stacker 37.

Figure 4:
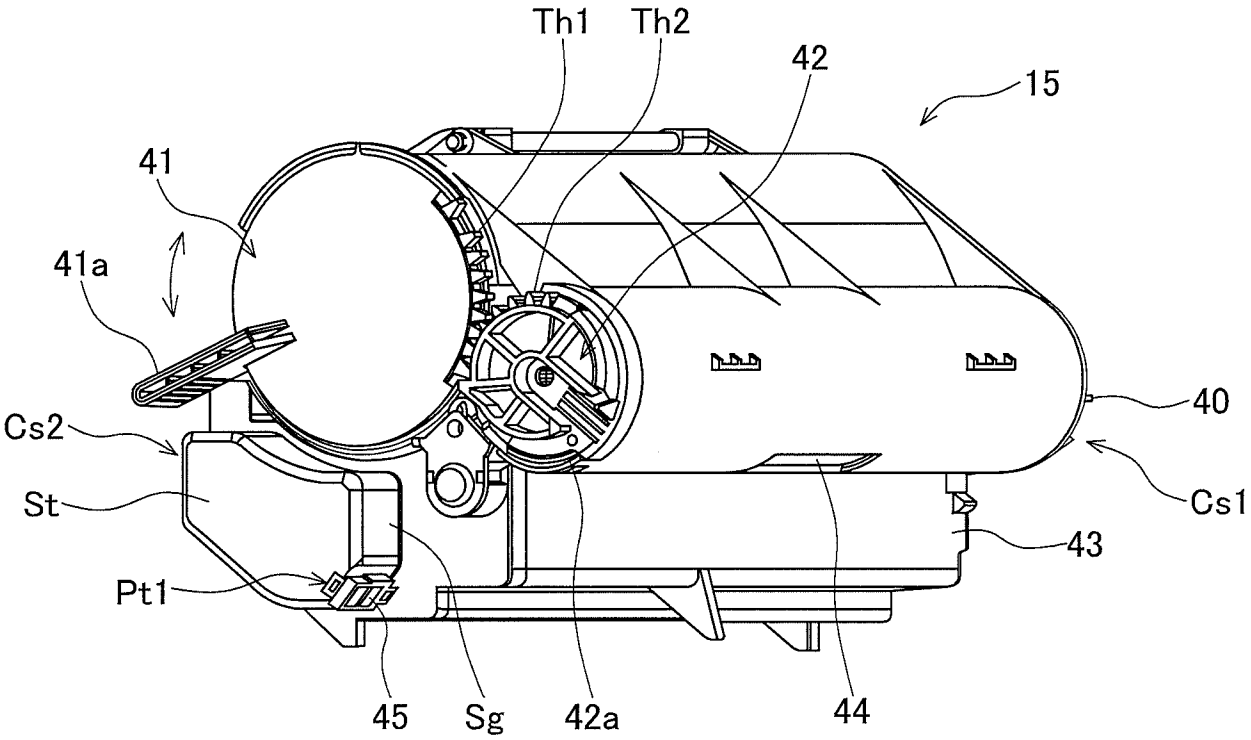
FIG. 4 is a perspective view of a toner cartridge in the first embodiment.

FIG. 4 is a perspective view of the toner cartridge 15. The toner cartridge 15 will be described with reference to FIG. 4.

In FIG. 4, the toner cartridge 15 has a case Cs1. The case Cs1 includes a toner case 40 as a first developer storage chamber, and the waste toner container 43 as a second developer storage chamber. The toner case 40 is formed of a cylindrical body, and stores the toner 14 therein. The waste toner container 43 is formed to be adjacent to and suspended downward from the toner case 40, and stores the waste toner conveyed by the conveying spiral 25. The toner cartridge 15 extends in a longitudinal direction thereof. The toner case 40 and the waste toner container 43 each extend in a longitudinal direction thereof parallel to the longitudinal direction of the toner cartridge 15.

A lever 41 with a circular shape is provided rotatably with respect to the toner case 40 at one end in its longitudinal direction. A handle 41*a* as an operating portion is formed at a predetermined position of the lever 41. The toner case 40 has an opening 44 for supplying the toner 14 to the image forming unit main body 20 (see FIG. 3). The opening 44 is formed at a center in the longitudinal direction of the toner case 40 so as to open downward.

A shutter 42 is provided to be adjacent to the lever 41 and rotatable with respect to the toner case 40. The shutter 42 has an opening/closing member (not shown) extending in the toner case 40 for opening and closing the opening 44, and a locking member 42*a* for locking the toner cartridge 15 to the image forming unit main body 20.

Driving side teeth Th1 are formed on a predetermined portion of a circumference of the lever 41. Driven side teeth Th2 are formed on a predetermined portion of a circumference of the shutter 42. The teeth Th1 and Th2 mesh with each other so that the shutter 42 rotates with rotation of the lever 41, which can be rotated by operating the handle 41*a*.

When attaching the toner cartridge 15 to the image forming unit main body 20, an operator sets the toner cartridge 15 to a mounting position in the image forming unit main body 20, and operates the handle 41*a* to rotate the lever 41. Thereby, the shutter 42 rotates to lock and fix the toner cartridge 15 to the image forming unit main body 20 by the locking member 42*a*, and open the opening 44 to supply the toner 14 in the toner case 40 to the image forming unit main body 20.

In this embodiment, the printer 10 is configured so that the controller 30 can obtain, from the toner cartridge 15, information regarding the toner cartridge 15 (i.e., replacement unit information), information regarding the toner 14 stored in the toner cartridge 15 (i.e., developer information), or the like, as described below.

A case convex portion Cs2 is formed at a predetermined position of the case Cs1 (in this embodiment, at one end in the longitudinal direction of the waste toner container 43 and below the lever 41) so as to project in the longitudinal direction of the toner cartridge 15 by a predetermined amount. A substrate mounting portion Pt1 is formed over an area from an end surface St as a first surface of the case convex portion Cs2 to a side surface Sg as a second surface of the case convex portion Cs2. A substrate member (or board member) 45 is detachably mounted to the substrate mounting portion Pt1.

Figure 5:
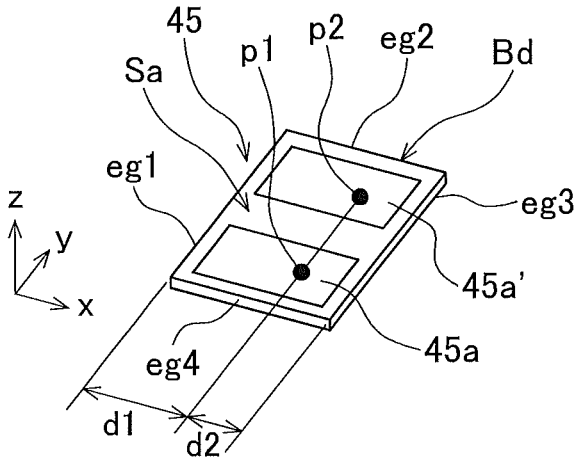
FIG. 5 is a first perspective view of a substrate member in the first embodiment.
Figure 6:
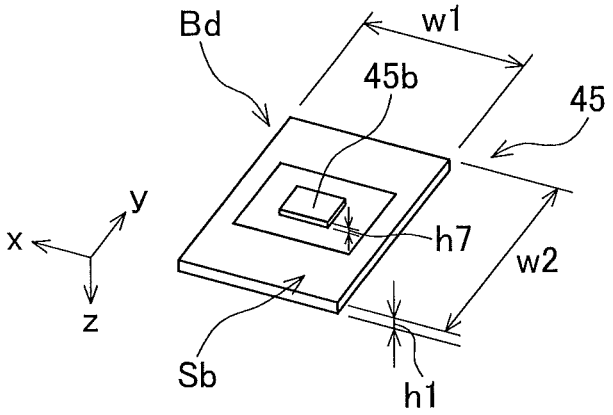
FIG. 6 is a second perspective view of the substrate member in the first embodiment.

FIGS. 5 and 6 are perspective views of the substrate member 45 as seen from different directions. The substrate member 45 will be described with reference to FIGS. 5 and 6.

The substrate member 45 includes a substrate (or board) Bd as a substrate portion (or board portion), a pair of contact portions 45*a* and 45*a*', and a memory (or an integrated circuit (IC) chip including a memory) 45*b* as a projecting portion. The substrate Bd has a front surface Sa as a first surface and a back surface Sb as a second surface. The front surface Sa and the back surface Sb are opposite to each other in a thickness direction of the substrate Bd. The thickness direction is parallel to a direction from the front surface Sa toward the back surface Sb. The substrate Bd has a predetermined thickness h1 in the thickness direction. The thickness h1 is a distance between the front surface Sa and the back surface Sb. The back surface Sb is a surface on which the memory 45*b* as an electrical component mounted on the substrate Bd is disposed. The contact portions 45*a* and 45*a*' are formed on the front surface Sa of the substrate Bd, and each have a rectangular shape. The memory 45*b* is disposed on the back surface Sb of the substrate Bd so as to project therefrom, and electrically connected to the contact portions 45*a* and 45*a*'. Information, such as the replacement unit information and the developer information, is recorded in the memory 45*b*. When the toner cartridge 15 is mounted to the image forming unit main body 20, the contact portions (or contact pads) 45*a*' electrically contact electrical contacts 50 and 51 (see FIG. 15), described later, provided in the apparatus main body 1 at contact points p1 and p2 by point contact, respectively.

The substrate Bd has a rectangular shape, and has a long edge portion eg1 as a first edge surface (side surface), a short edge portion eg2 as a second edge surface (side surface), a long edge portion eg3 as a third edge surface (side surface), and a short edge portion eg4 as a fourth edge surface (side surface). Specifically, each of the edge portions eg1 to eg4 is an edge surface joining the front surface Sa and the back surface Sb. When it is assumed that a length of the short edge portions eg2 and eg4 is w1, and a length of the long edge portions eg1 and eg3 is w2, the length w2 is greater than the length w1. Thus, the following formula is satisfied:

$$w1<w2.$$

The long edge portions eg1 and eg3 extend in a longitudinal direction of the substrate Bd and parallel to each other. The short edge portions eg2 and eg4 extend in a lateral direction of the substrate Bd and parallel to each other. The long edge portions eg1 and eg3 extend perpendicularly to the short edge portions eg2 and eg4. In this specification, the term "parallel" is intended to include not only completely parallel but also substantially parallel. The term "perpendicularly" is intended to include not only completely perpendicularly but also substantially perpendicularly. The term "substantially" is intended to allow deviation of up to 5° from completely parallel or completely perpendicularly.

When it is assumed that a distance from the contact points p1 and p2 to the long edge portion eg1 is d1, and a distance from the contact points p1 and p2 to the long edge portion eg3 is d2, the distances d1 and d2 are different from each other. Thus, the following formula is satisfied:

$$d1\neq d2.$$

In the following description, for convenience, it is assumed that the direction in which the short edge portions eg2 and eg4 extend is an x direction as a first direction; the direction in which the long edge portions eg1 and eg3 extend is a y direction as a second direction; the thickness direction of the substrate Bd is a z direction as a third direction. Further, it is assumed that the direction from the long edge portion eg1 toward the long edge portion eg3 in the x direction is a +x direction; the direction from the long edge portion eg3 toward the long edge portion eg1 in the x direction is a −x direction; the direction from the short edge portion eg4 toward the short edge portion eg2 in the y direction is a +y direction; the direction from the short edge portion eg2 toward the short edge portion eg4 in the y direction is a −y direction; the direction from the back surface Sb toward the front surface Sa in the z direction is a +z direction; the direction from the front surface Sa toward the back surface Sb in the z direction is a −z direction. The x direction is identical to the lateral direction of the substrate member 45; the y direction is identical to the longitudinal directions of the substrate member 45 and the toner cartridge 15; the z direction is identical to the thickness direction of the substrate member 45.

Figure 1:
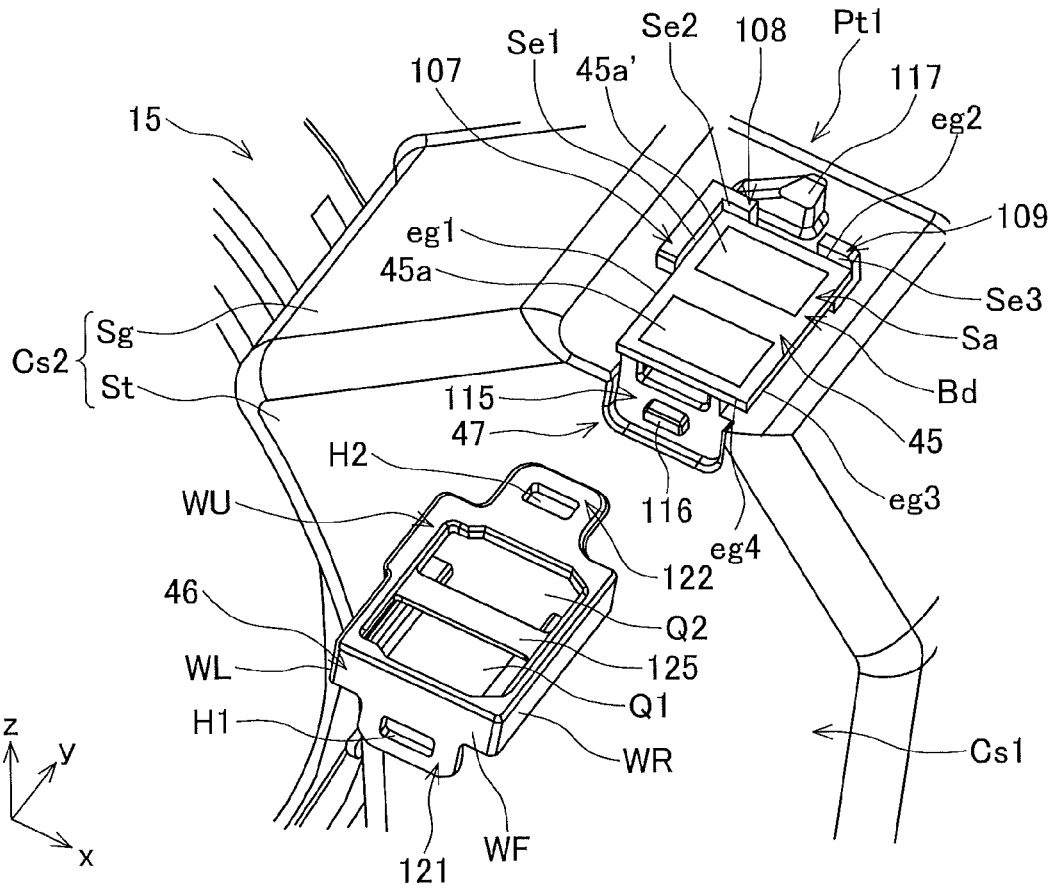
FIG. 1 is an exploded perspective view of a substrate mounting portion in a first embodiment of the invention.

FIG. 1 is an exploded perspective view of the substrate mounting portion Pt1. The substrate mounting portion Pt1 will be described with reference to FIG. 1.

The substrate mounting portion Pt1 includes a mounting portion 47 as a first mounting member, and a cover 46 as a second mounting member. The mounting portion 47 is formed at a predetermined position of the case convex portion Cs2. The substrate member 45 is placed or set on the mounting portion 47 so that the front surface Sa faces upward and the back surface Sb faces downward. The cover 46 is attached to the mounting portion 47 so as to cover the substrate member 45, thereby holding or fixing the substrate member 45 on the mounting portion 47. The substrate member 45, the mounting portion 47, and the cover 46 constitute a substrate mounting structure.

Figure 7:
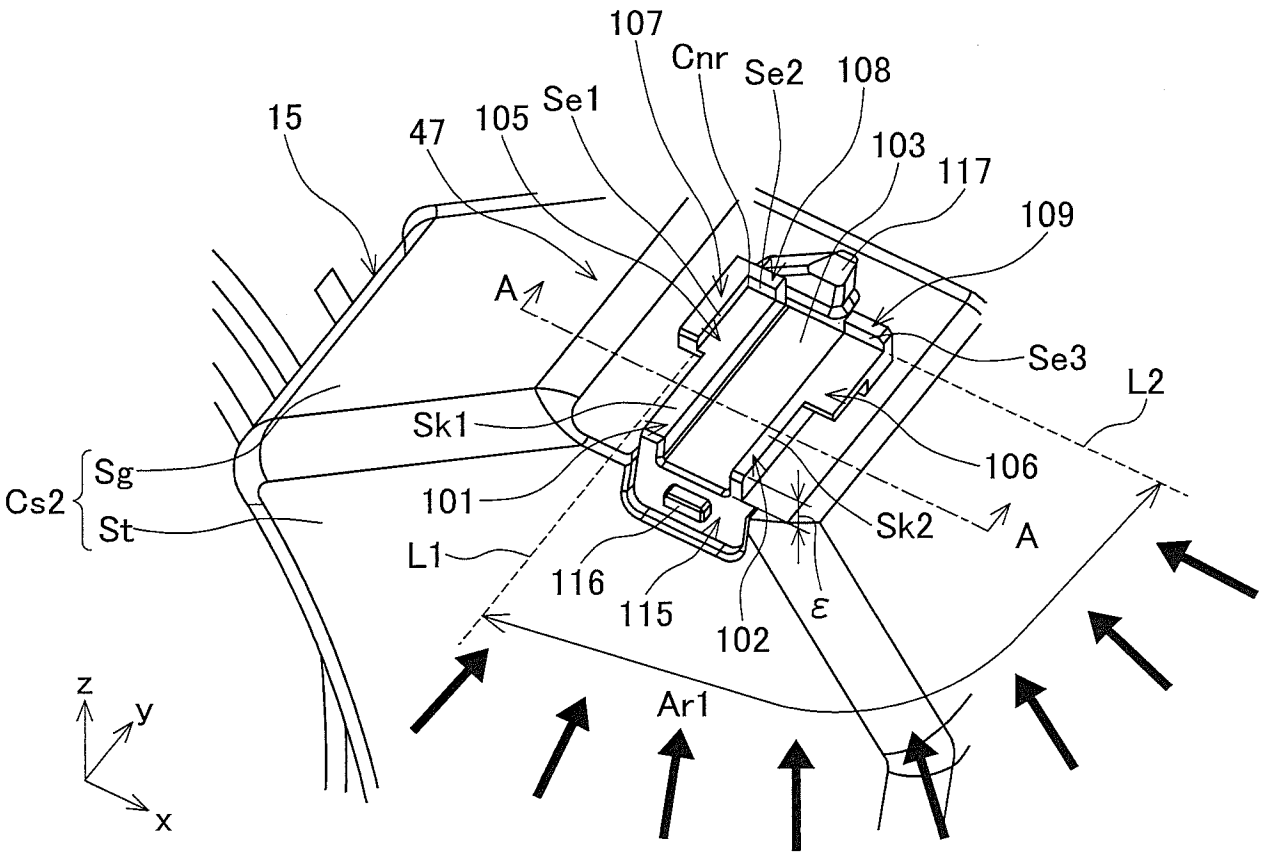
FIG. 7 is a perspective view of a mounting portion in the first embodiment.
Figure 8:
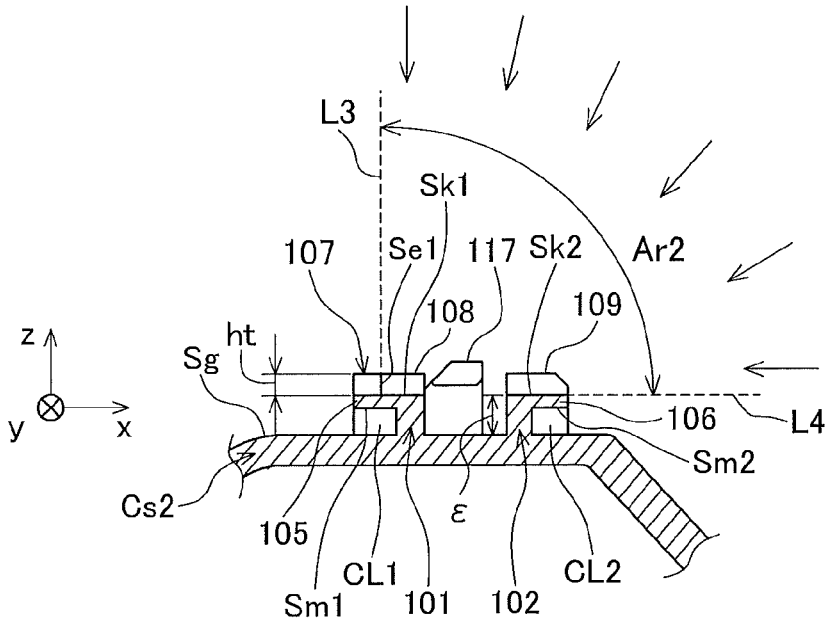
FIG. 8 is a sectional view along line A-A in FIG. 7.

FIG. 7 is a perspective view of the mounting portion 47. FIG. 8 is a sectional view along line A-A in FIG. 7. The mounting portion 47 will be described with reference to FIGS. 7 and 8.

The mounting portion 47 includes two supports 101 and 102 for supporting the substrate member 45 when the substrate member 45 is placed on the mounting portion 47. The supports 101 and 102 are formed to extend in the +y direction from the end surface St, which is formed at one end side in the longitudinal direction of the toner cartridge 15, toward the other end side of the toner cartridge 15, and parallel to each other with a predetermined interval therebetween. A groove 103 as an accommodating portion is formed to extend in the +y direction between the supports 101 and 102. The groove 103 is formed to have a concave shape by the supports 101 and 102, and opens at the end surface St. A depth ϵ of the groove 103 is set to prevent the memory 45*b* from contacting a bottom of the groove 103 when the substrate member 45 is placed on the mounting portion 47. That is, the depth ϵ is set to be greater than a height h7 of the memory 45*b* from the back surface Sb (see FIG. 6).

The supports 101 and 102 extend along the long edge portions eg1 and eg3 in the +y direction from their ends of the short edge portion eg4 side (hereinafter referred to as "support front ends") to their ends of the short edge portion eg2 side (hereinafter referred to as "support rear ends") by a distance equal to the length w2 of the long edge portions eg1 and eg3. The supports 101 and 102 have thickness-direction supports Sk1 and Sk2 that are support surfaces formed on the surfaces of the supports 101 and 102, respectively. The thickness-direction supports Sk1 and Sk2 abut on the back surface Sb of the substrate Bd to support the substrate member 45. The thickness-direction supports Sk1 and Sk2 are formed on the same plane. The supports 101 and 102 have overhangs 105 and 106, respectively. The overhang 105 is formed at a predetermined portion in the y direction of the support 101 (in this embodiment, from a vicinity of the center to the support rear end) so as to project sideward (in the −x direction). The overhang 105 is wider in a width direction of the support 101 (the x direction) than a portion from the support front end to the center of the thickness-direction support Sk1. The overhang 106 is formed at a predetermined portion in the y direction of the support 102 (in this embodiment, from a vicinity of the center to the support rear end) so as to project sideward (in the +x direction). The overhang 106 is wider in a width direction of the support 102 (the x direction) than a portion from the support front end to the center of the thickness-direction support Sk2.

A first rising portion 107 and a second rising portion 108 are formed on one of the overhangs 105 and 106 (in this embodiment, the overhang 105), and a third rising portion 109 is formed on the other of the overhangs 105 and 106 (in this embodiment, the overhang 106). The first rising portion 107 is formed to rise in the +z direction from an outer edge (the −x edge) of the overhang 105. The second rising portion 108 is formed to rise in the +z direction from a rear end (the +y end) of the overhang 105. The third rising portion 109 is formed to rise in the +z direction from a rear end (the +y end) of the overhang 106.

As above, the mounting portion 47 includes the first to third rising portions 107 to 109. A long edge support Se1 as a first restricting portion is formed on the first rising portion 107. Short edge supports Se2 and Se3 as a second restricting portion are formed on the second and third rising portions 108 and 109, respectively. The long edge support Se1 is an inner side surface (the +x side surface) of the first rising portion 107. The short edge supports Se2 and Se3 are inner side surfaces (the −y side surfaces) of the second and third rising portions 108 and 109, respectively. When the substrate member 45 is placed on the mounting portion 47, the long edge support Se1 abuts on the long edge portion eg1 of the substrate Bd, and the short edge supports Se2 and Se3 abut on the short edge portion eg2 of the substrate Bd. The short edge supports Se2 and Se3 are formed on the same plane.

The first rising portion 107 has a rib shape extending in the longitudinal direction of the toner cartridge 15 (the y direction), and is formed to project in the +z direction from the thickness-direction support Sk1 of the support 101. The second and third rising portions 108 and 109 each have a rib shape extending in the lateral direction of the toner cartridge 15 (the x direction), and are formed to project in the +z direction from the thickness-direction supports Sk1 and Sk2 of the supports 101 and 102. The second and third rising portions 108 and 109 are formed opposite to each other in the x direction with the groove 103 interposed therebetween in this embodiment, but may be connected to each other to be integrally formed.

The long edge support Se1 extends perpendicularly to the short edge supports Se2 and Se3. The thickness-direction support Sk1 extends perpendicularly to the long edge support Se1 and the short edge support Se2. The thickness-direction support Sk2 extends perpendicularly to the short edge support Se3.

The first rising portion 107 and the second rising portion 108 extend perpendicularly to each other, and form a corner Cnr at an intersection therebetween (i.e., an intersection between the long edge support Se1 and the short edge support Se2).

When it is assumed that a height of the first to third rising portions 107 to 109 from the thickness-direction supports Sk1 and Sk2 is ht, the height ht is greater than the thickness h1 of the substrate Bd (see FIG. 6). Thus, the following formula is satisfied:

$$ht > h1.$$

The mounting portion 47 is provided with a recess 115 for receiving the cover 46, a projection 116 as a first engaging portion, and a projection 117 as a second engaging portion so that the cover 46 can be attached to the mounting portion 47 to cover the substrate member 45. The recess 115 is formed adjacent to the support front ends of the supports 101 and 102 so as to be recessed from the end surface St in the longitudinal direction of the toner cartridge 15 (the +y direction). The projection 116 is formed in the recess 115 so as to project forward (in the −y direction) from a bottom of the recess 115. The projection 117 is formed between the second rising portion 108 and the third rising portion 109 (substantially at a center of the substrate member 45 placed on the mounting portion 47) in the lateral direction of the toner cartridge 15 (the x direction), and on a side opposite to the thickness-direction supports Sk1 and Sk2 across the second and third rising portions 108 and 109 in the longitudinal direction of the toner cartridge 15 (the y direction). The projection 117 is adjacent to the second and third rising portions 108 and 109, and projects in the +z direction with respective to the thickness-direction supports Sk1 and Sk2 and the first to third rising portions 107 to 109.

A locking portion Sm1 is formed by a surface of the overhang 105 on a side opposite to the thickness-direction support Sk1, and a space CL1 is formed between the locking portion Sm1 and the side surface Sg of the case convex portion Cs2. Similarly, a locking portion Sm2 is formed by a surface of the overhang 106 on a side opposite to the thickness-direction support Sk2, and a space CL2 is formed between the locking portion Sm2 and the side surface Sg of the case convex portion Cs2.

The long edge support Se1 serves as the first restricting portion that abuts on the long edge portion eg1 of the substrate Bd to restrict movement of the substrate member 45 in the −x direction when the substrate member 45 is placed on the mounting portion 47. The short edge supports Se2 and Se3 serve as the second restricting portion that abuts on the short edge portion eg2 of the substrate Bd to restrict movement of the substrate member 45 in the +y direction when the substrate member 45 is placed on the mounting portion 47. The thickness-direction supports Sk1 and Sk2 serve as the third restricting portion that abuts on the back surface Sb of the substrate Bd to restrict movement of the substrate member 45 in the −z direction when the substrate member 45 is placed on the mounting portion 47.

Figure 9:
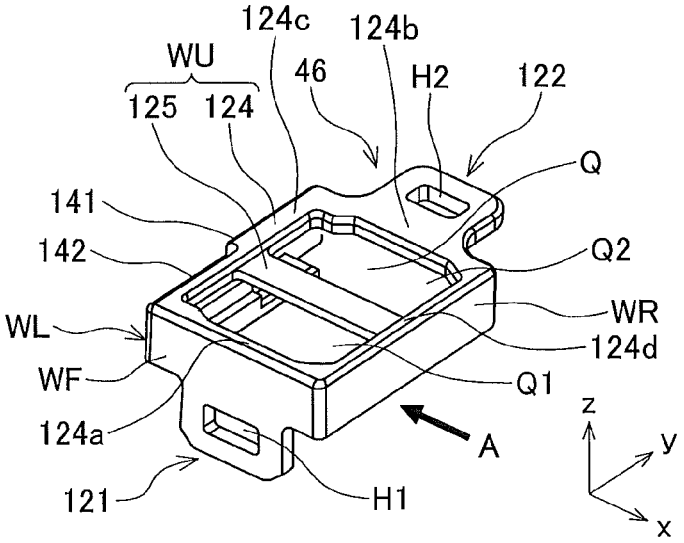
FIG. 9 is a first perspective view of a cover in the first embodiment.
Figure 10:
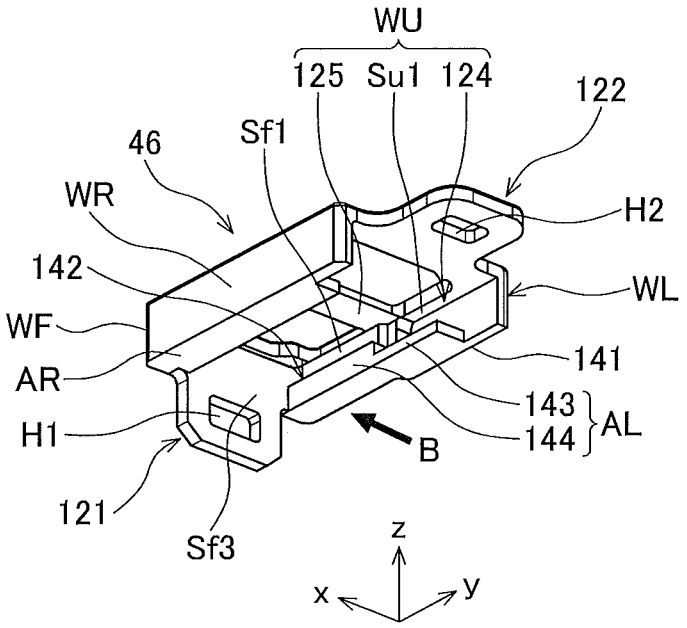
FIG. 10 is a second perspective view of the cover in the first embodiment.
Figure 11:
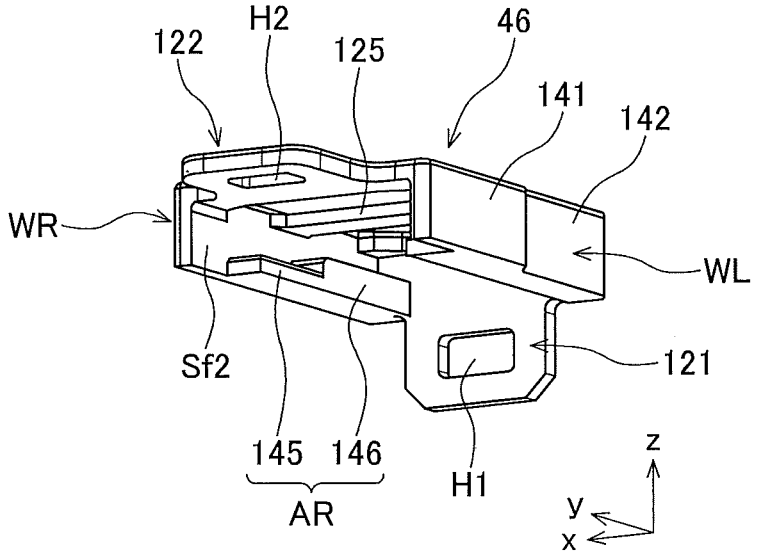
FIG. 11 is a third perspective view of the cover in the first embodiment.

FIG. 9 is a perspective view of the cover 46. FIG. 10 is a perspective view of the cover 46 as seen from a direction indicated by arrow A in FIG. 9. FIG. 11 is a perspective view of the cover 46 as seen from a direction indicated by arrow B in FIG. 10. The cover 46 will be described with reference to FIGS. 9 to 11.

After the substrate member 45 is placed on the mounting portion 47, the cover 46 is slid from the short edge portion eg4 side of the substrate Bd in the +y direction to be attached to the mounting portion 47.

The cover 46 has a rectangular shape, and has an upper plate WU as an upper wall, side plates WL and WR as first and second side walls, and a front plate WF as a front wall. The upper plate WU serves as a wall that covers the front surface Sa of the substrate member 45 from above to restrict movement of the front surface Sa in the upward direction (+z direction). The side plates WL and WR are suspended from the upper plate WU in the −z direction. The side plate WL serves as a first wall that restricts movement of the long edge portion eg1 of the substrate Bd in the −x direction. The side plate WR serves as a second wall that restricts movement of the long edge portion eg3 of the substrate Bd in the +x direction. The front plate WF is suspended from the upper plate WU in the −z direction, and serves as a third wall that restricts movement of the short edge portion eg4 of the substrate Bd in the −y direction.

The upper plate WU includes a frame 124 having a rectangular shape. The frame 124 has a front portion 124*a*, a rear portion 124*b*, a first side portion 124*c*, and a second side portion 124*d*, which are located on the −y, +y, −x, and +x sides of the frame 124, respectively. The front portion 124*a* and the rear portion 124*b* extend in the x direction away from each other in the y direction. The first side portion 124*c* and the second side portion 124*d* extend in the y direction away from each other in the x direction. The first side portion 124*c* connects the −x ends of the front portion 124*a* and the rear portion 124*b*. The second side portion 124*d* connects the +x ends of the front portion 124*a* and the rear portion 124*b*. The front portion 124*a*, the rear portion 124*b*, the first side portion 124*c*, and the second side portion 124*d* form an opening Q penetrating in the z direction. The upper plate WU further includes a connecting member 125 connecting a side plate WL side and a side plate WR side of the frame 124. Specifically, the connecting member 125 connects a center in the y direction of the first side portion 124*c* and a center in the y direction of the second side portion 124*d*. The connecting member 125 divides the opening Q in the frame 124 into first and second windows (or openings) Q1 and Q2. The upper plate WU has a thickness-direction restricting portion Su1, which is an inner surface (the −z side surface) of the upper plate WU. The thickness-direction restricting portion Su1 abuts on the front surface Sa of the substrate member 45 to hold the substrate member 45 from above when the substrate member 45 is placed on the mounting portion 47 and the cover 46 is attached to the mounting portion 47. The first and second windows Q1 and Q2 are formed to face the contact portions 45*a* and 45*a*', and thus the contact portions 45*a* and 45*a*' are exposed outside the cover 46 through the first and second windows Q1 and Q2, respectively.

An extending portion 121 is formed to project from the front plate WF in the −z direction, and a hole H1 is formed in the extending portion 121 as a first engaged portion to be engaged with the projection 116. An extending portion 122 is formed to project from the upper plate WU in the +y direction, and a hole H2 is formed in the extending portion 122 as a second engaged portion to be engaged with the projection 117.

A projection 141 is formed in one of the side plates WL and WR (in this embodiment, the side plate WL) to project outward (in this embodiment, in the −x direction) so as to accommodate the first rising portion 107 when the cover 46 is attached to the mounting portion 47. When the cover 46 is attached to the mounting portion 47, the side plate WL covers the support 101, the side plate WR covers the support 102, and the front plate WF covers the support front ends.

The side plate WL has a non-projecting portion 142 that is a portion other than the projection 141 of the side plate WL, and a long edge restricting portion Sf1 that is an inner side surface (the +x side surface) of the non-projecting portion 142. The side plate WR has a long edge restricting portion Sf2 that is an inner side surface (the −x side surface) of the side plate WR. The front plate WF has a short edge restricting portion Sf3 that is an inner side surface (the +y side surface) of the front plate WF. When the cover 46 is attached to the mounting portion 47, the long edge restricting portion Sf1 abuts on the long edge portion eg1 of the substrate Bd, the long edge restricting portion Sf2 abuts on the long edge portion eg3 of the substrate Bd, and the short edge restricting portion Sf3 abuts on the short edge portion eg4 of the substrate Bd.

An arm AL is formed to project inward (in the +x direction) from a lower end (−z end) of the side plate WL. The arm AL has a locked portion 143 and an abutting portion 144. The locked portion 143 is formed at a position corresponding to the overhang 105, and enters the space CL1 to be engaged with the locking portion Sm1 when the cover 46 is attached to the mounting portion 47. The abutting portion 144 is formed on the extending portion 121 side (the −y direction side) of the locked portion 143, and abuts on the −x side of the support 101 when the cover 46 is attached to the mounting portion 47. An arm AR is formed to project inward (in the −x direction) from a lower end (−z end) of the side plate WR. The arm AR has a locked portion 145 and an abutting portion 146. The locked portion 145 is formed at a position corresponding to the overhang 106, and enters the space CL2 to be engaged with the locking portion Sm2 when the cover 46 is attached to the mounting portion 47. The abutting portion 146 is formed on the extending portion 121 side (the −y direction side) of the locked portion 145, and abuts on the +x side of the support 102 when the cover 46 is attached to the mounting portion 47.

The thickness-direction restricting portion Su1 extends perpendicularly to the long edge restricting portions Sf1 and Sf2 and the short edge restricting portion Sf3. The long edge restricting portions Sf1 and Sf2 extend perpendicularly to the short edge restricting portion Sf3.

The long edge restricting portion Sf2 serves as a fourth restricting portion that abuts on the long edge portion eg3 of the substrate Bd to restrict movement of the substrate member 45 in the +x direction when the substrate member 45 is placed on the mounting portion 47 and the cover 46 is attached to the mounting portion 47. The short edge restricting portion Sf3 serves as a fifth restricting portion that abuts on the short edge portion eg4 of the substrate Bd to restrict movement of the substrate member 45 in the −y direction when the substrate member 45 is placed on the mounting portion 47 and the cover 46 is attached to the mounting portion 47. The thickness-direction restricting portion Su1 serves as a sixth restricting portion that abuts on the front surface Sa of the substrate Bd from above to restrict movement of the substrate member 45 in the +z direction when the substrate member 45 is placed on the mounting portion 47 and the cover 46 is attached to the mounting portion 47. The long edge restricting portion Sf1 serves as a seventh restricting portion that abuts on the long edge portion eg1 of the substrate Bd to restrict movement of the substrate member 45 in the −x direction when the substrate member 45 is placed on the mounting portion 47 and the cover 46 is attached to the mounting portion 47.

FIG. 7 shows extension lines L1 and L2, and an area Ar1. The extension line L1 extends in the −y direction from the long edge support Se1 of the first rising portion 107 (specifically, the intersection between the long edge support Se1 and the thickness-direction support Sk1). The extension line L2 extends in the +x direction from the short edge supports Se2 and Se3 of the second and third rising portions 108 and 109 (specifically, the intersection between the short edge support Se3 and the thickness-direction support Sk2). The area Ar1 is an area facing the long edge support Se1 and the short edge supports Se2 and Se3 between the extension lines L1 and L2. FIG. 8 shows extension lines L3 and L4, and an area Ar2. The extension line L3 extends in the +z direction from the long edge support Se1 of the first rising portion 107. The extension line L4 extends in the +x direction from the thickness-direction supports Sk1 and Sk2 of the supports 101 and 102. The area Ar2 is an area between the extension lines L3 and L4.

As described above, the substrate mounting portion Pt1 is formed on the case convex portion Cs2, which is formed at one end of the waste toner container 43 (see FIG. 4) below the lever 41. Thus, there is no member, such as the toner case 40, the waste toner container 43, the lever 41, and the shutter 42, that obstructs mounting of the substrate member 45 in the areas Ar1 and Ar2. For example, there is no member projecting in the +z direction from the thickness-direction supports Sk1 and Sk2 in the areas Ar1 and Ar2. There is no member projecting in the thickness direction of the substrate Bd from the third restricting portion in an area facing the first and second restricting portions.

In other words, the position of the substrate mounting portion Pt1 in the case Cs1, the positions of the first to third rising portions 107 to 109 in the substrate mounting portion Pt1, or the like are set so that there is no member, such as the toner case 40, the waste toner container 43, the lever 41, and the shutter 42, within the areas Ar1 and Ar2.

With the above configuration, the substrate member 45 can be easily mounted to the substrate mounting portion Pt1.

For the same purpose, the toner cartridge 15 or the substrate mounting structure may be configured so that no member other than the substrate member 45 and the cover 46 exists in an area facing the first to third restricting portions. The above area is, for example, defined by a plane including the first restricting portion, a plane including the second restricting portion, and a plane including the third restricting portion.

Next, a method of mounting the substrate member 45 to the substrate mounting portion Pt1 will be described.

First, in the area Ar1 or Ar2, the substrate member 45 is put on the thickness-direction supports Sk1 and Sk2, and the long edge portion eg1 of the substrate Bd is brought into contact with the first rising portion 107 and the short edge portion eg2 of the substrate Bd is brought into contact with the second and third rising portions 108 and 109. Thereby, the substrate member 45 is positioned with respect to the supports 101 and 102, and placed on the mounting portion 47.

Here, the first rising portion 107 and the second and third rising portions 108 and 109 extend in the directions perpendicular to each other and restrict movement of the long edge portion eg1 and the short edge portion eg2. Thus, the substrate member 45 can be placed on the thickness-direction supports Sk1 and Sk2 from various directions, and can be easily placed on the mounting portion 47.

It is noted that another rising portion may be provided parallel to the first rising portion 107 so as to abut on the long edge portion eg3. However, this configuration limits the placement direction from which the substrate member 45 is placed on the thickness-direction supports Sk1 and Sk2.

Then, the cover 46 is moved in the +y direction, and the locked portions 143 and 145 are inserted into the spaces CL1 and CL2 to be engaged with the locking portions Sm1 and Sm2, respectively.

Here, as described above, the height ht of the first to third rising portions 107 to 109 from the thickness-direction supports Sk1 and Sk2 is greater than the thickness of the substrate Bd. While the cover 46 is moved in the +y direction, the thickness-direction restricting portion Su1 of the upper plate WU abuts on the upper surface of the first rising portion 107. Thus, the substrate member 45 can be prevented from being displaced due to abutment with the cover 46.

When the cover 46 is further moved in the +y direction, the projections 116 and 117 engage the holes H1 and H2, respectively, and thereby the cover 46 is fixed to the mounting portion 47.

In this manner, the substrate member 45 is mounted to the substrate mounting portion Pt1.

Figure 12:
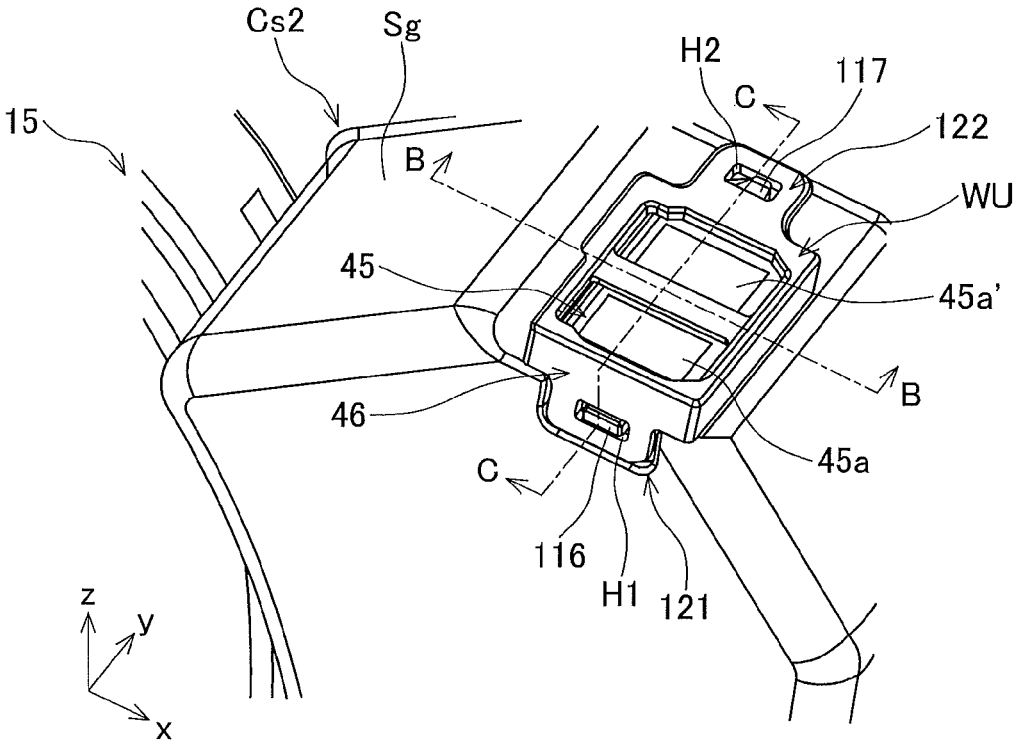
FIG. 12 is a perspective view showing a state where the substrate member has been mounted to the substrate mounting portion in the first embodiment.
Figure 13:
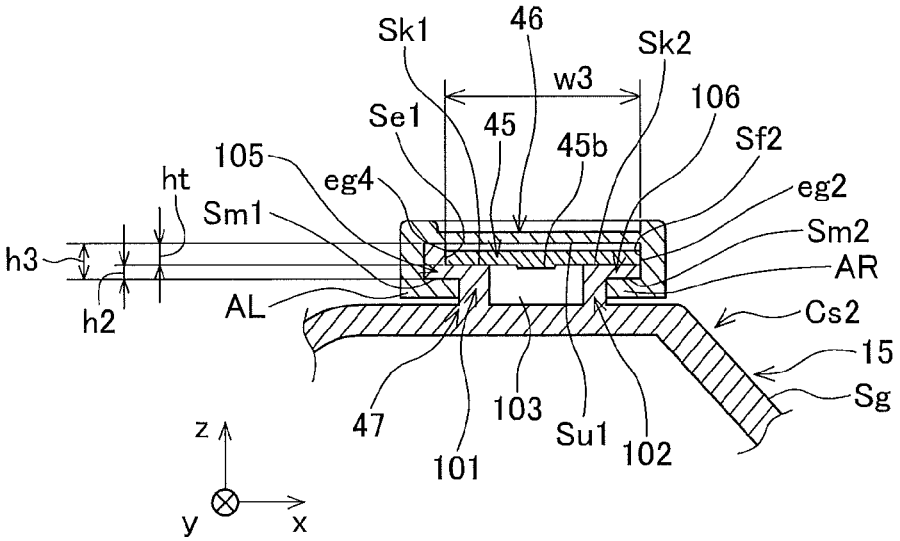
FIG. 13 is a sectional view along line B-B in FIG. 12.
Figure 14:
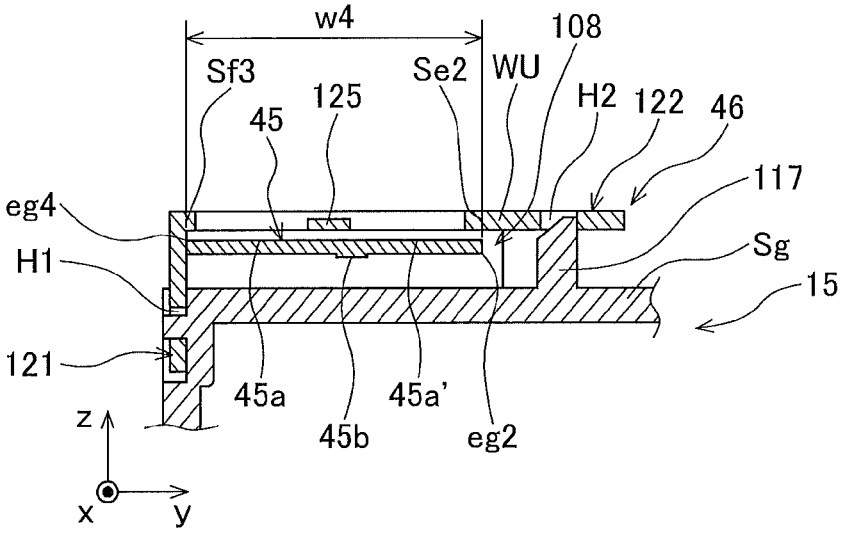
FIG. 14 is a sectional view along line C-C in FIG. 12.

FIG. 12 is a perspective view showing a state where the substrate member 45 has been mounted to the substrate mounting portion Pt1. FIGS. 13 and 14 are sectional views along lines B-B and C-C in FIG. 12, respectively. The state where the substrate member 45 has been mounted to the substrate mounting portion Pt1 will be described.

In FIG. 13, a distance in the z direction from the locking portions Sm1 and Sm2, which are formed by the back surfaces of the overhangs 105 and 106, to the thickness-direction supports Sk1 and Sk2, which are formed by the front surfaces of the supports 101 and 102, is assumed to be h2. A distance in the z direction from the locking portions Sm1 and Sm2 to the thickness-direction restricting portion Su1 of the upper plate WU is assumed to be h3. Specifically, the distance h3 is a value in a state where the locked portions 143 and 145 are in contact with the locking portions Sm1 and Sm2 in the z direction. In order to move the cover 46 in the +y direction to engage the locked portions 143 and 145 (see FIGS. 10 and 11) with the locking portions Sm1 and Sm2, respectively, the height ht of the first to third rising portions 107 to 109 from the thickness-direction supports Sk1 and Sk2 needs to satisfy the following formula:

$$ht \leq h3 - h2.$$

In one preferred aspect, to form sufficient clearance between the mounting portion 47 and the cover 46, the following formula is satisfied:

$$ht<h3-h2.$$

Further, in FIG. 13, a distance in the x direction from the long edge support Se1 of the first rising portion 107 to the long edge restricting portion Sf2 of the side plate WR is assumed to be w3. Specifically, the distance w3 is a value a state where the side plate WL is in contact with the first rising portion 107 in the x direction. In order to move the cover 46 in the +y direction, the distance w3 and the length w1 of the short edge portions eg2 and eg4 need to satisfy the following formula:

$$w1\leq w3.$$

In one preferred aspect, to form clearance in the lateral direction (the x direction) of the substrate member 45 between the long edge support Se1 and the long edge portion eg1, and between the long edge restricting portion Sf2 and the long edge portion eg3, the following formula is satisfied:

$$w1<w3.$$

Further, in FIG. 14, a distance in the y direction from the short edge supports Se2 and Se3 of the second and third rising portions 108 and 109 to the short edge restricting portion Sf3 of the front plate WF is assumed to be w4. Specifically, the distance w4 is a value in a state where the projections 116 and 117 engage the holes H1 and H2. In order to attach the cover 46 to the mounting portion 47, the distance w4 and the length w2 of the long edge portions eg1 and eg3 need to satisfy the following formula:

$$w2\leq w4.$$

In one preferred aspect, to form clearance in the longitudinal direction of the substrate member 45 between the short edge supports Se2 and Se3 and the short edge portion eg2, and between the short edge restricting portion Sf3 and the short edge portion eg4, the following formula is satisfied:

$$w2<w4.$$

Figure 15:
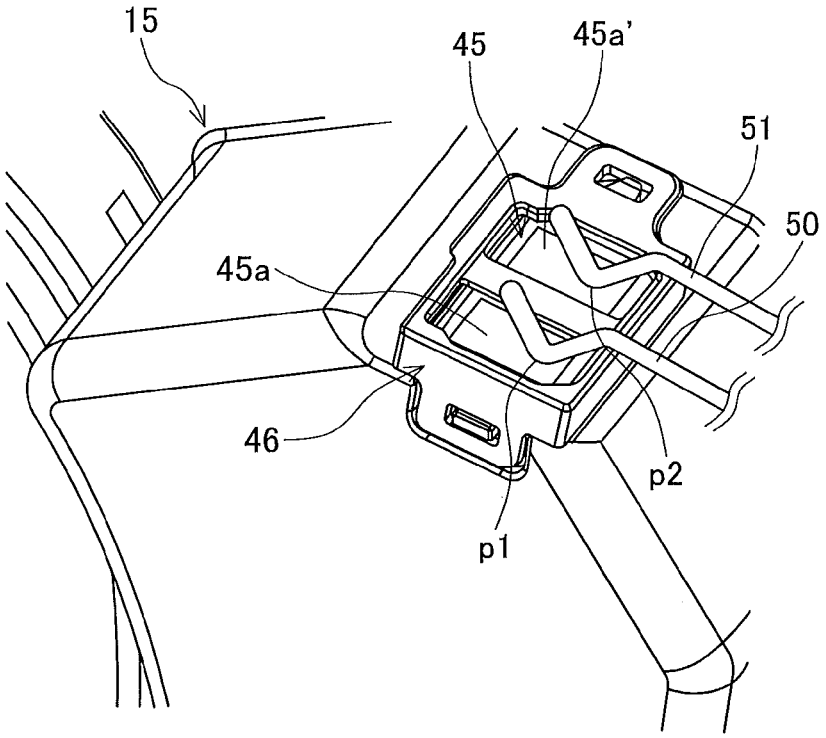
FIG. 15 is a perspective view showing a state where an image forming unit has been mounted to an apparatus main body of the printer in the first embodiment.

FIG. 15 is a perspective view showing a state where the image forming unit 31 has been mounted to the apparatus main body 1 of the printer 10. The state where the image forming unit 31 has been mounted to the apparatus main body 1 will be described with reference to FIG. 15.

In FIG. 15, a pair of electrical contacts 50 and 51 are provided in the apparatus main body 1. The electrical contacts 50 and 51 contact the contact portions 45*a* and 45*a*' of the substrate member 45 at the contact points p1 and p2, respectively, and thereby the memory 45*b* (see FIG. 6) and the apparatus main body 1 are electrically connected to each other. Thereby, the controller 30 (see FIG. 2) in the apparatus main body 1 can read out and obtain the replacement unit information, the developer information, or other information recorded in the memory 45*b*. Further, the controller 30 can update information, such as the replacement unit information and the developer information, recorded in the memory 45*b*, or write new information into the memory 45*b*.

In FIG. 1, the substrate member 45 is placed on the mounting portion 47 so that the long edge portion eg1 of the substrate Bd abuts on the long edge support Se1 of the first rising portion 107. However, the substrate member 45 can be rotated by 180° around an axis extending in the z direction (i.e., a z axis) and be placed on the mounting portion 47 so that the long, edge portion eg3 of the substrate Bd abuts on the long edge support Se1.

As described above, the distance d1 from the contact points p1 and p2 to the long edge portion eg1 and the distance d2 from the contact points p1 and p2 to the long edge portion eg3 are set to be different from each other. That is, the following formula is satisfied:

$$d1\neq d2.$$

Thus, the electrical contacts 50 and 51 contact the contact portions 45*a* and 45*a*' at different points thereon depending on the mounting direction of the substrate member 45 to the mounting portion 47, that is, which of the long edge portions eg1 and eg3 abuts on the long edge support Se1.

With this configuration, by altering the mounting direction of the substrate member 45, deterioration of the contact portions 45*a* and 45*a*' due to friction with the electrical contacts 50 and 51 can be suppressed, and thereby durability of the substrate member 45 can be improved.

As described above, in this embodiment, the substrate mounting portion Pt1 is formed on the case convex portion Cs2 of the toner cartridge 15, the substrate member 45 with the memory 45*b* is mounted to the substrate mounting portion Pt1, and the electrical contacts 50 and 51 contact the contact portions 45*a* and 45*a*' of the substrate member 45. Thus, the apparatus main body 1 can easily obtain information, such as the replacement information and the developer information.

Further, movement of the substrate member 45 placed on the mounting portion 47 is restricted by the long edge support Se1, the short edge supports Se2 and Se3, and the thickness-direction supports Sk1 and Sk2 of the mounting portion 47, and the long edge restricting portion Sf2, the short edge restricting portion Sf3, and the thickness-direction restricting portion Su1 of the cover 46. Thus, the substrate member 45 can be surely mounted to the substrate mounting portion Pt1.

Second Embodiment

Next, a printer in the second embodiment will be described. This printer is nearly identical to the one in the first embodiment, so parts that are the same as in the first embodiment have the same reference characters, and descriptions thereof will be omitted or simplified.

Figure 16:
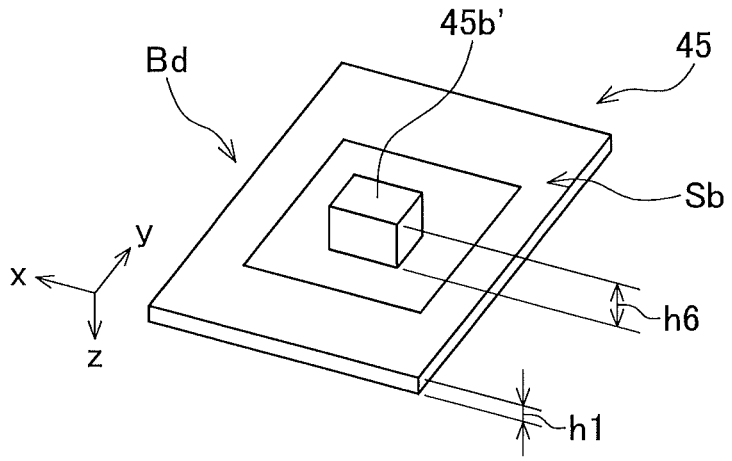
FIG. 16 is a perspective view of a substrate member in the second embodiment.

FIG. 16 is a perspective view of a substrate member 45 in the second embodiment.

In FIG. 16, the substrate member 45 includes a substrate Bd as a substrate portion, and a memory 45*b*' as a projecting portion on a back surface Sb as a second surface of the substrate Bd.

The depth ϵ of the groove 103 as an accommodating portion (see FIG. 7) is set to prevent the memory 45*b*' from contacting a bottom of the groove 103 when the substrate member 45 is placed on the mounting portion 47 as a first mounting member. That is, when a height of the memory 45*b*' from the back surface Sb of the substrate Bd is assumed to be h6, the following formula is satisfied:

$$\epsilon>h6.$$

In this embodiment, the height h6 of the memory 45*b*' is set so that the sum γ of the height h6 and the thickness h1 of the substrate Bd is greater than the height ht (see FIG. 8) of the first to third rising portions 107 to 109 from the thickness-direction supports Sk1 and Sk2. That is, the following formula is satisfied:

$$\gamma=h6+h1>ht.$$

When the substrate member 45 is placed on the mounting portion 47 with its back surface Sb in contact with the thickness-direction supports Sk1 and Sk2, since the memory 45*b*' is positioned in the groove 103, the cover 46 can be attached to the mounting portion 47. On the other hand, when the substrate member 45 is placed on the mounting portion 47 with its front surface Sa in contact with the thickness-direction supports Sk1 and Sk2, the memory 45*b*' is not positioned in the groove 103, but projected upward (i.e., in the +z direction) so as to face the thickness-direction restricting portion Su1. In this case, since the sum γ is, as described above, greater than the height ht, when the cover 46 is tried to be attached to the mounting portion 47, the substrate member 45 and the cover 46 interfere with each other and the cover 46 cannot be attached to the mounting portion 47.

As above, in this embodiment, when the substrate member 45 is placed on the mounting portion 47 upside down by mistake, the cover 46 cannot be attached to the mounting portion 47 due to the interference between the substrate member 45 and the cover 46. Therefore, the substrate member 45 can be appropriately mounted to the substrate mounting portion Pt1.

For the same purpose, the height h6 may be set so that the sum γ is greater than a distance h4 from the thickness-direction supports Sk1 and Sk2 to the thickness-direction restricting portion Su1 in the z direction. That is, the following formula may be satisfied:

$$\gamma = h6 + h1 > h4.$$

The distance h4 is, for example, a value in a state where the locked portions 143 and 145 are in contact with the locking portions Sm1 and Sm2 in the z direction. In this case, the distance h4 is expressed by the following formula using the distances h2 and h3 (see FIG. 13):

$$h4 = h3 - h2.$$

While the preferred embodiments of the present invention have been illustrated in detail, it should be apparent that modifications and improvements may be made to the invention without departing from the spirit and scope of the invention as described in the following claims.

For example, in the above description, the printer has been described as an example of the image forming apparatus. However, the present invention is applicable to a copier, a facsimile machine, a multi-function peripheral (MFP), or other image forming apparatus.

What is claimed is:

1. A substrate mounting structure, comprising:

a substrate member including a substrate portion, the substrate portion having a first surface and a second surface opposite to each other in a thickness direction of the substrate portion, first to fourth side surfaces, and a predetermined thickness in the thickness direction, each of the first to fourth side surfaces joining the first surface to the second surface;

a first mounting member on which the substrate member is placed, the first mounting member including a first restricting portion abutting on the first side surface to restrict movement of the substrate member, a second restricting portion abutting on the second side surface to restrict movement of the substrate member, and a third restricting portion abutting on the second surface to restrict movement of the substrate member in the thickness direction, and a second mounting member attached to the first mounting member to hold the substrate member on the first mounting member, the second mounting member including a fourth restricting portion abutting on the third side surface to restrict movement of the substrate member, a fifth restricting portion abutting on the fourth side surface to restrict movement of the substrate member, and a sixth restricting portion abutting on the first surface to restrict movement of the substrate member, wherein the first side surface and the second side surface extend perpendicularly to each other, and the third side surface and the fourth side surface extend perpendicularly to each other.

2. The substrate mounting structure of claim 1, wherein the first restricting portion and the second restricting portion extend perpendicularly to each other, and the fourth restricting portion and the fifth restricting portion extend perpendicularly to each other.

3. The substrate mounting structure of claim 1, wherein no member other than the substrate member and the second mounting member exists in an area facing the first to third restricting portions.

4. The substrate mounting structure of claim 1, wherein:

the substrate member further includes a projecting portion projecting in the thickness direction from the substrate portion;

the first mounting member includes an accommodating portion accommodating the projecting portion when the substrate member is placed on the first mounting member; and the accommodating portion has a depth greater than a height of the projecting portion from the substrate portion.

5. The substrate mounting structure of claim 4, wherein the sum of the predetermined thickness of the substrate portion and the height of the projecting portion is greater than a distance between the third restricting portion and the sixth restricting portion.

6. A developer container comprising the substrate mounting structure of claim 1.

7. The developer container of claim 6, wherein the first restricting portion and the fourth restricting portion extend substantially in parallel with a longitudinal direction of the developer container.

8. An image forming unit comprising the substrate mounting structure of claim 1.

9. An image forming apparatus comprising the substrate mounting structure of claim 1.

10. The image forming apparatus of claim 9, wherein:

the substrate portion has a contact portion formed on the first surface; and the image forming apparatus includes an electrical contact contacting the contact portion.

11. The image forming apparatus of claim 10, wherein:

the electrical contact contacts the contact portion at a contact point;

a distance between the contact point and the first side surface is different from a distance between the contact point and the third side surface.

12. The substrate mounting structure of claim 1, wherein the first mounting member includes a first engaging portion that is engaged with the second mounting member, and a second engaging portion that is engaged with the second mounting member, and wherein the second mounting member includes a first engaged portion that is disposed in the fifth restricting portion and is engaged with the first engaging portion, and a second engaged portion that is disposed in the sixth restricting portion and is engaged with the second engaging portion.

13. The substrate mounting structure of claim 1, wherein the second mounting member is movable relative to the first mounting member and attached to the first mounting member by sliding the second mounting member in a same direction parallel to the first and third side surfaces.

14. The substrate mounting structure of claim 1, wherein the first side surface is substantially parallel to the third side surface, the second side surface is substantially parallel to the fourth side surface, the first restricting portion restricts movement of the substrate member in a direction from the third side surface toward the first side surface, the second restricting portion restricts movement of the substrate member in a direction from the fourth side surface toward the second side surface, the fourth restricting portion restricts movement of the substrate member in a direction from the first side surface toward the third side surface, and the fifth restricting portion restricts movement of the substrate member in a direction from the second side surface toward the fourth side surface.

15. The substrate mounting structure of claim 1, wherein each of the first and second surfaces of the substrate portion and each of the first to fourth side surfaces of the substrate portions are different surfaces from each other.

16. The substrate mounting structure of claim 1, wherein the first to fourth side surfaces define a thickness of the substrate portion.

17. A substrate mounting method comprising:

placing a substrate member on a first mounting member, the substrate member including a substrate portion, the substrate portion having a first surface and a second surface opposite to each other in a thickness direction of the substrate portion, first to fourth side surfaces, and a predetermined thickness in the thickness direction, each of the first to fourth side surfaces joining the first surface to the second surface; and attaching a second mounting member to the first mounting member to hold the substrate member on the first mounting member, wherein:

the first mounting member includes a first restricting portion abutting on the first side surface to restrict movement of the substrate member, a second restricting portion abutting on the second side surface to restrict movement of the substrate member, and a third restricting portion abutting on the second surface to restrict movement of the substrate member in the thickness direction; and the second mounting member includes a fourth restricting portion abutting on the third side surface to restrict movement of the substrate member, a fifth restricting portion abutting on the fourth side surface to restrict movement of the substrate member, and a sixth restricting portion abutting on the first surface to restrict movement of the substrate member; and the first side surface and the second side surface extend perpendicularly to each other, and the third side surface and the fourth side surface extend perpendicularly to each other.

18. The substrate mounting method of claim 17, wherein the attaching the second mounting member to the first mounting member includes sliding the second mounting member relative to the first mounting member in a same direction parallel to the first and third side surfaces to attach the second mounting member to the first mounting member.

* * * * *